US008607459B2

(12) United States Patent
Geissler

(10) Patent No.: US 8,607,459 B2
(45) Date of Patent: Dec. 17, 2013

(54) CONDIMENT DISPENSING UTENSIL

(76) Inventor: Amanda Geissler, Hayward, WI (US)

( * ) Notice: Subject to any disclaimer, the term of this patent is extended or adjusted under 35 U.S.C. 154(b) by 562 days.

(21) Appl. No.: 12/822,769

(22) Filed: Jun. 24, 2010

(65) Prior Publication Data

US 2010/0325895 A1 Dec. 30, 2010

Related U.S. Application Data

(60) Provisional application No. 61/219,935, filed on Jun. 24, 2009.

(51) Int. Cl.
*A47J 43/28* (2006.01)

(52) U.S. Cl.
USPC ..... 30/141; 30/125; 30/322; 30/324

(58) Field of Classification Search
USPC ..... 30/125, 123.3, 124, 141, 322–328, 128, 30/129; 222/630–637, 191, 192, 251, 253, 222/255
See application file for complete search history.

(56) References Cited

U.S. PATENT DOCUMENTS

| | | | | |
|---|---|---|---|---|
| 1,317,691 | A | 10/1919 | Fields | |
| 2,453,525 | A * | 11/1948 | McNeill | 30/123.3 |
| 2,698,996 | A * | 1/1955 | Hickerson | 30/123 |
| 3,931,741 | A | 1/1976 | Ceccarelli | |
| 5,316,187 | A * | 5/1994 | Drobish et al. | 222/401 |
| 5,491,895 | A | 2/1996 | Lee | |
| 5,873,167 | A | 2/1999 | Mason | |
| 5,881,956 | A | 3/1999 | Cohen et al. | |
| 6,006,952 | A * | 12/1999 | Lucas | 222/211 |
| 6,279,233 | B1 | 8/2001 | Cameron | |
| 7,175,215 | B2 | 2/2007 | Harris | |
| 7,210,600 | B1 * | 5/2007 | Delio, Jr. | 222/92 |
| 2007/0196159 | A1 * | 8/2007 | Sogaro | 401/186 |
| 2010/0186237 | A1 * | 7/2010 | Cunningham | 30/123.3 |

* cited by examiner

*Primary Examiner* — Phong Nguyen
(74) *Attorney, Agent, or Firm* — Patterson Thuente Pedersen, P.A.

(57) ABSTRACT

A utensil apparatus for dispensing a quantity of condiment. The condiment dispensing utensil is constructed such that it contains an internal reservoir of a condiment, such as a salad dressing. The condiment dispensing utensil assembly can then be used to dispense a bite-sized portion of the condiment to the food on the utensil as it is consumed. The utensil allows the user to control the amount of condiment that is consumed at a single meal. Said utensil can later be cleaned for reuse or disposed of if constructed for only a single serving use. The utensil also comprises a pump mechanism for controlling the amount of condiment that is dispensed with each bite or scoop of food.

6 Claims, 13 Drawing Sheets

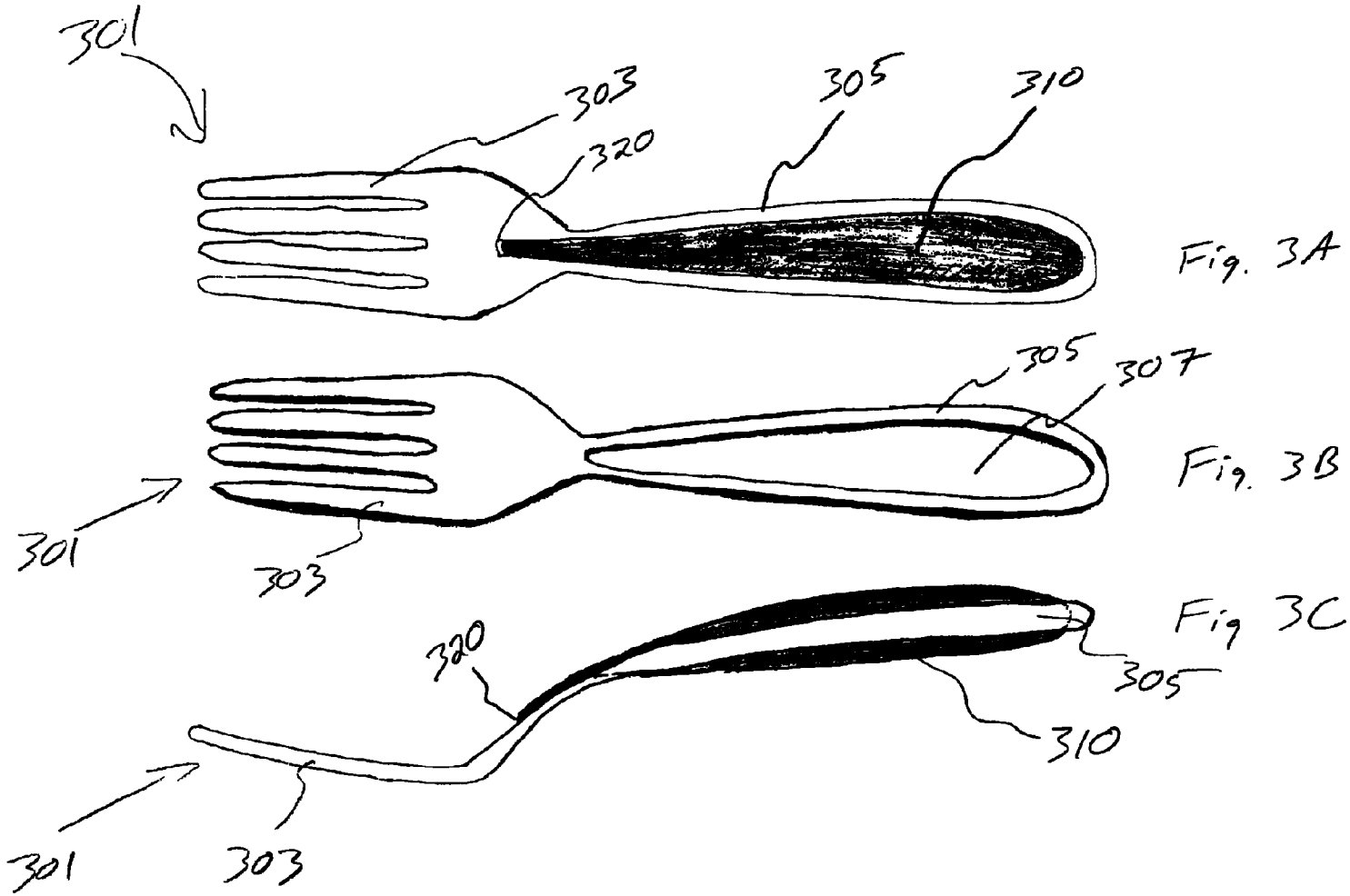
Fig. 3(A-C)

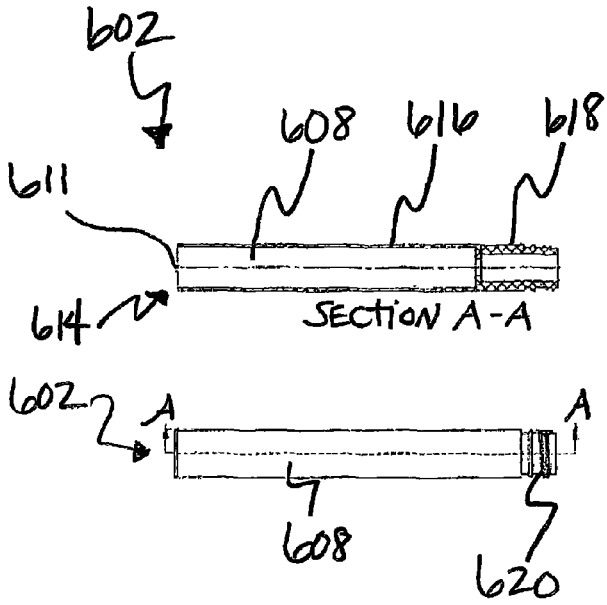
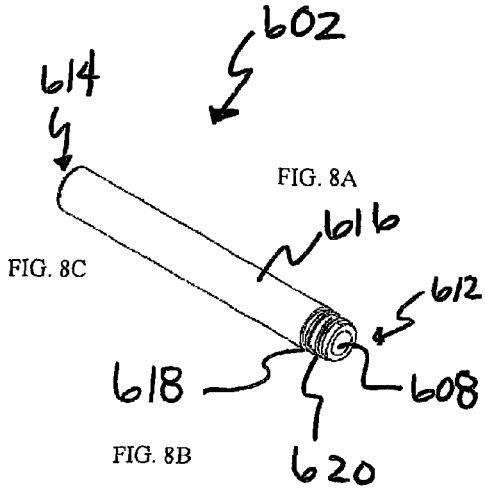
FIG. 8A
FIG. 8C
FIG. 8B
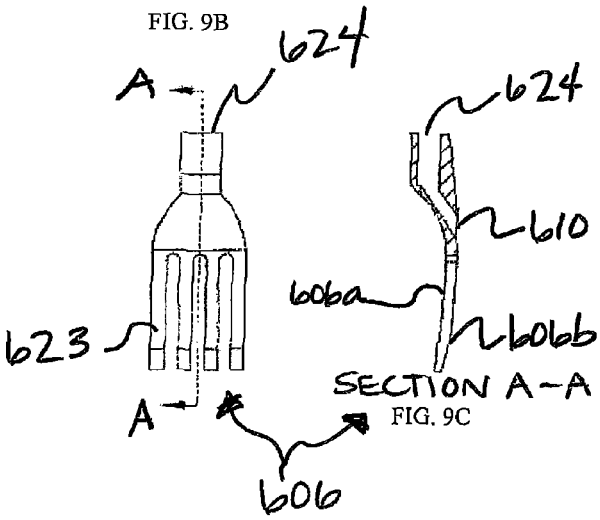
FIG. 9B
FIG. 9C
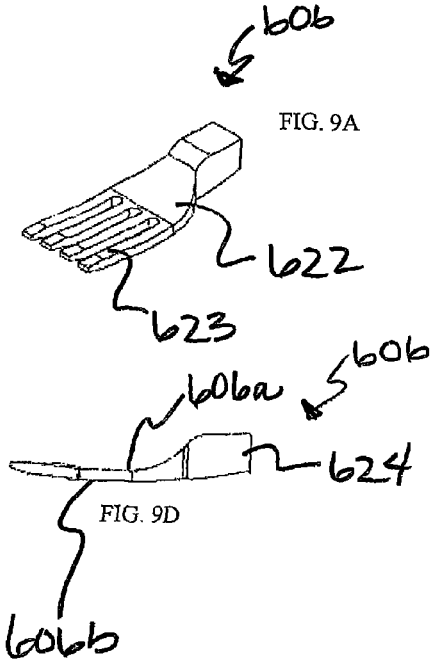
FIG. 9A
FIG. 9D FIG. 10B
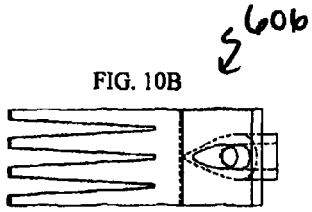
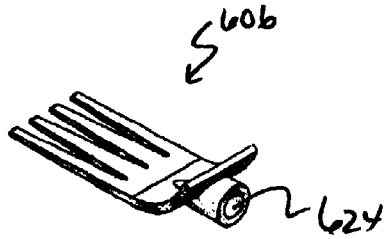
FIG. 10A
FIG. 10E
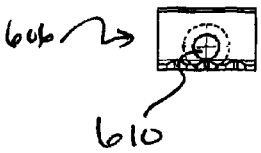
FIG. 10D
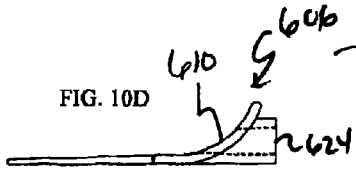
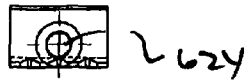
FIG. 10C
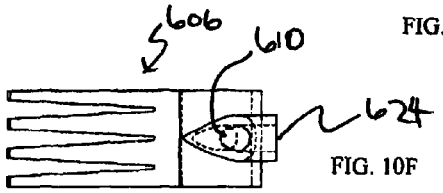
FIG. 10F
FIG. 11A
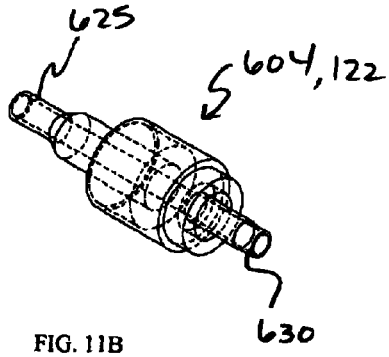
FIG. 11D
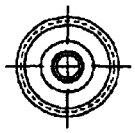
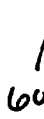
FIG. 11C
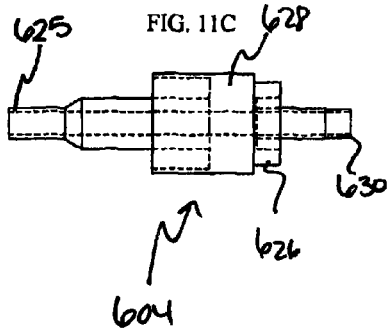
FIG. 11B
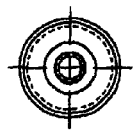
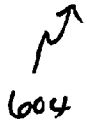

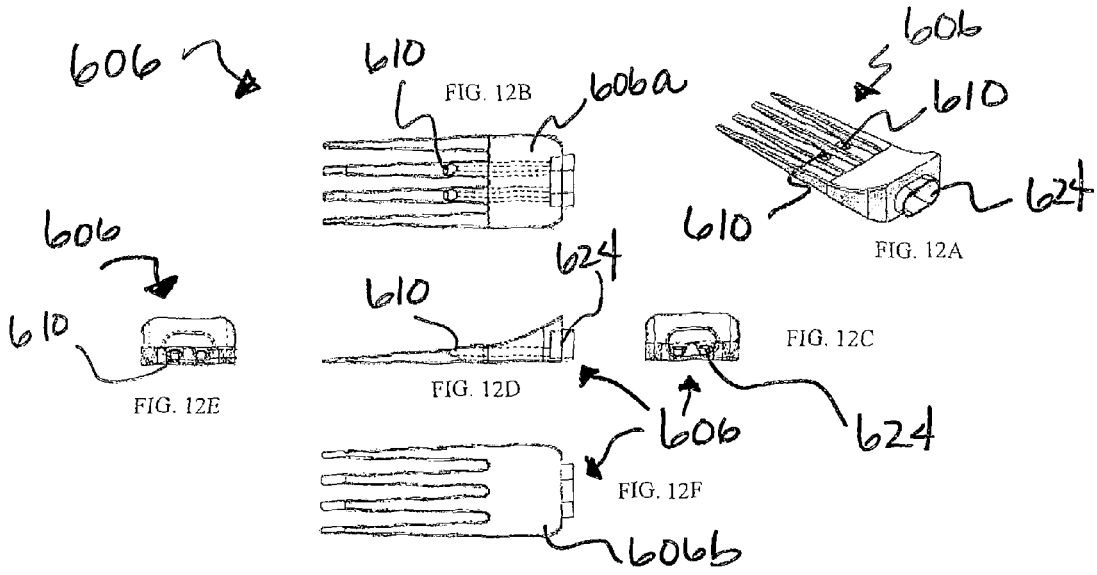
FIG. 12B
FIG. 12A
FIG. 12E
FIG. 12D
FIG. 12C
FIG. 12F
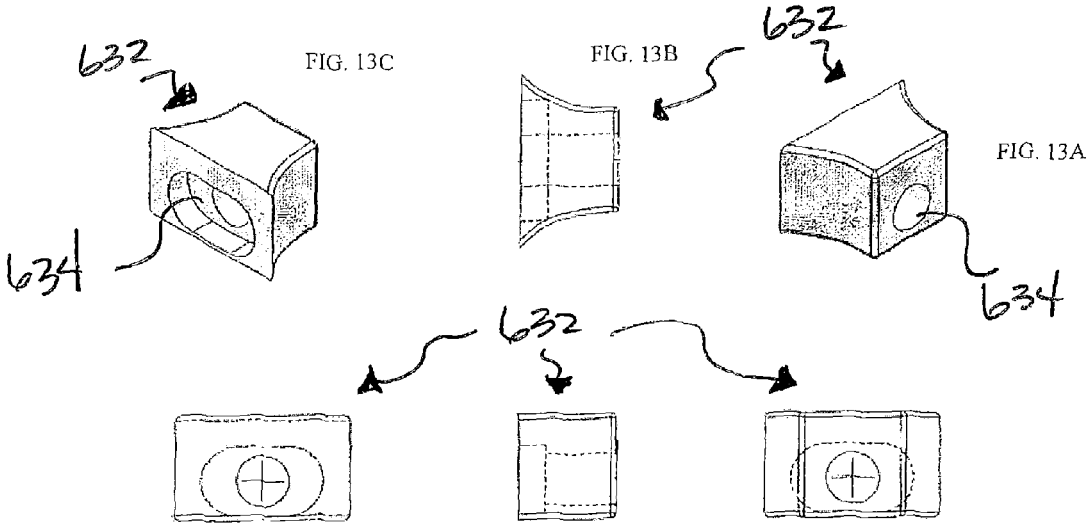
FIG. 13C
FIG. 13B
FIG. 13A
FIG. 13F
FIG. 13E
FIG. 13D

CONDIMENT DISPENSING UTENSIL

PRIORITY CLAIM

This application claims the benefit of U.S. Provisional Application Ser. No. 61/219,935 filed Jun. 24, 2009, and entitled "CONDIMENT DISPENSING UTENSIL," which is hereby incorporated by reference in its entirety.

FIELD OF THE INVENTION

The present invention is generally directed to the field of utensils for use as a condiment dispenser. More specifically, the present invention is directed to a method, apparatus, and utensil for dispensing a fixed quantity of a condiment, such as a salad dressing.

BACKGROUND OF THE INVENTION

The concept of condiment dispensing containers has been practiced for many years. These concepts can range from the relatively simple such as, for example, the ubiquitous salt and pepper shakers, glass bottles, and plastic squeeze bottles, to more complex systems for dispensing ketchup from sealed containers into paper cups at fast-food restaurants. Regardless of design, the general principle involves a reservoir of the condiment and an opening or dispenser through which a user applies the condiment to their food.

A variety of condiment dispensing utensil designs include, for example, U.S. Pat. Nos. 1,317,691 to Fields; 7,175,215 to Harris; and 5,873,167 to Mason, each of which is herein incorporated by reference in their entireties. A variety of specific spoon designs have also been contemplated for dispensing various edible substances. Representative examples include U.S. Pat. Nos. 5,491,895 to Lee; 3,931,741 to Ceccarelli; and 6,279,233 to Cameron.

These configurations have not provided optimal performance in controlling the amount of a condiment that is dispensed while eating. Typically, the amount of condiment that is applied to a meal will depend on the user shaking, pouring, or squeezing the condiment container until a satisfactory amount has been dispensed. In such an arrangement, the user may not be aware of the portion size that they are consuming with each application of the condiment. This situation may lead to an undesired excess consumption of the condiment or other edible substance. This excess consumption may lead to non-compliance with a dietary regime and, over a period of time, undesired weight gain. Additionally, when applying a condiment directly to a meal, as in the case of pouring salad dressing onto a bowl of salad, the distribution of dressing over each bite of salad is often not uniform unless a large quantity of dressing is applied. Again, this over application of calorie-laden dressing may be undesirable.

Furthermore, the application of a condiment to a food product or meal can cause undesirable characteristics to the food product if the food product is saved for later consumption. For example, in the case of salad dressing applied to a bowl of salad, if the salad is not consumed in its entirety and/or immediately, application of the salad dressing to the lettuce causes the lettuce to become soggy over time, and can render the salad inconsumable or undesirable to eat at a later time.

While the above-referenced patents have suggested various improvements to the field of condiment dispensing utensils, there remains a need to identify improved designs that have a mechanism for controlling the application of a specific quantity of a condiment from a container, while still providing a convenient, uniform, and cost-effective method of applying the condiment to each bite of the user's meal.

SUMMARY OF THE INVENTION

A condiment dispensing utensil according to embodiments of the present invention is reliable, cost effective, and can be used to dispense a fixed amount of a condiment from the container more accurately than the devices described above. Furthermore, a condiment can be applied to each individual bite using the condiment dispensing utensil according to embodiments of the invention, rather than the entire food product, thereby allowing uneaten portions to be saved for later consumption without comprising quality of the food product. Also, the condiment dispensing utensil can provide portability allowing one to carry only the condiment-containing utensil, instead of an entire container or bottle of condiment.

Generally, a representative embodiment of this invention would be to form a utensil in the shape of a fork, spoon, knife, or other eating utensil including a reservoir. Various types of material, including, but not limited to, plastics may be used to form the body of the utensil. This plastic, or other material, should be of a type that is safe for the use of food consumption by humans. Further, a clear plastic or other transparent material, allows the user to determine whether the utensil contains a condiment, the type of condiment based on the condiment's color, and/or the amount of condiment that the utensil contains.

In one embodiment, the condiment reservoir can preferably be sized to only contain a single serving amount of the desired condiment. This single serving design helps the user strictly regulate the amount of a given condiment that is consumed. Utensils of various sized reservoirs may be constructed in order to accommodate the different serving portions that are appropriate for various condiments. In an alternative embodiment, the condiment reservoir can be sized to contain a plurality of servings of the desired condiment.

In one embodiment of the invention, a salad fork can be constructed with a reservoir sized to contain a two-tablespoon serving of salad dressing. This size limitation helps to ensure that a person who is consuming a salad does not over apply a quantity of salad dressing that is dispensed from a traditional salad-dressing bottle. A pump mechanism, such as a spray mechanism, is disposed within the reservoir or between the reservoir and the food-carrying portion of the utensil. The pump mechanism can be actuated by a button or trigger, for example, at a location on the exterior of the handle of the utensil, or by depressing the food-carrying portion itself. Actuation of the pump allows the user to dispense a bite-sized quantity of salad dressing onto the salad with each bite as it is consumed.

The invention includes the methods for construction and use of the various configurations of the condiment dispensing utensils, usage of the various configurations, the individual components and sets of components, the apparatus, and the operation including the filling and dispensing of the apparatus contents.

As used throughout the present specification, the terms "anterior" or "proximal" and "posterior" or "distal" are intended to provide reference points for the various elements in which "anterior" or "proximal" refers to a direction nearest the end of a utensil that typically comes into contact with food when used, i.e. the food-carrying portion, while "posterior" or "distal" refers to a direction nearest the handle or portion of the utensil that a user would grasp or hold.

The above summary of the invention is not intended to describe each illustrated embodiment or every implementation of the present invention. The Figures and the detailed description that follow more particularly exemplify these embodiments.

BRIEF DESCRIPTION OF THE DRAWINGS

The invention can be more completely understood in consideration of the following detailed description of various embodiments of the invention in connection with the accompanying drawings, in which:

FIG. 1C is a perspective view of the posterior end of a condiment dispensing utensil according to an embodiment of the invention.

FIG. 3A is a top view of a condiment dispensing utensil in the form of a fork with attached condiment packet according to an embodiment of the invention.

FIG. 3B is a top view of a condiment dispensing utensil in the form of a fork without an attached condiment packet according to an embodiment of the invention.

FIG. 3C is a side view of a condiment dispensing utensil in the form of a fork with attached condiment packet according to an embodiment of the invention.

FIG. 8A is a perspective view of a hollow handle of the condiment dispensing utensil of FIG. 6A.

FIG. 8B is a side view of the handle of FIG. 8A.

FIG. 8C is a cross section taken at A-A of the handle of FIG. 8B.

FIG. 9A is a perspective view of a food-carrying portion in the form of fork tines of the condiment dispensing utensil of FIG. 6A.

FIG. 9B is a top view of the food-carrying portion of FIG. 9A.

FIG. 9C is a cross section taken at A-A of the food-carrying portion of FIG. 9B.

FIG. 9D is a side view of the food-carrying portion of FIG. 9A.

FIG. 10A is a perspective view of a food-carrying portion in the form of fork tines according to an alternative embodiment of the invention.

FIG. 10B is a top view of the food-carrying portion of FIG. 10A.

FIG. 10C is a rear view of the food-carrying portion of FIG. 10A.

FIG. 10D is a side view of the food-carrying portion of FIG. 10A.

FIG. 10E is a front view of the food-carrying portion of FIG. 10A.

FIG. 10F is a bottom view of the food-carrying portion of FIG. 10A.

FIG. 11A is a perspective view of a pump of the condiment dispensing utensil of FIG. 6A.

FIG. 11B is a rear view of the pump of FIG. 11A.

FIG. 11C is a side view of the pump of FIG. 11A.

FIG. 11D is a front view of the pump of FIG. 11A.

FIG. 12A is a perspective view of a food-carrying portion in the form of fork tines according to another alternative embodiment of the invention.

FIG. 12B is a top view of the food-carrying portion of FIG. 12A.

FIG. 12C is a rear view of the food-carrying portion of FIG. 12A.

FIG. 12D is a side view of the food-carrying portion of FIG. 12A.

FIG. 12E is a front view of the food-carrying portion of FIG. 12A.

FIG. 12F is a bottom view of the food-carrying portion of FIG. 12A.

FIG. 13A is a rear perspective view coupling member for coupling the food-carrying portion of FIG. 12A to a handle portion according to an embodiment of the invention.

FIG. 13B is a top view of the coupling member of FIG. 13A.

FIG. 13C is a front perspective view of the coupling member of FIG. 13A.

FIG. 13D is a rear view of the coupling member of FIG. 13A.

FIG. 13E is a side view of the coupling member of FIG. 13A.

FIG. 13F is a front view of the coupling member of FIG. 13A.

Figure 1A:
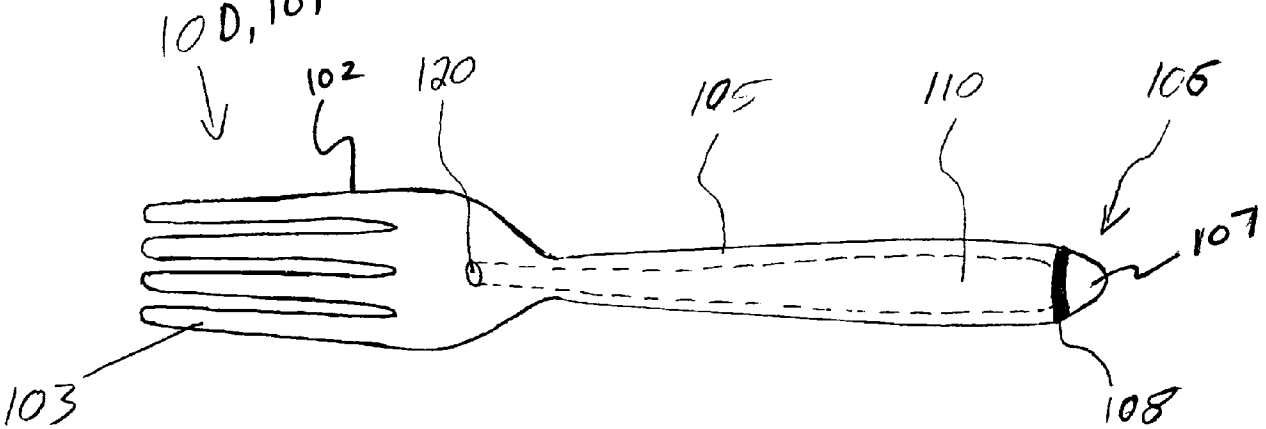
FIG. 1A is a top view of a condiment dispensing utensil in the form of a fork according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

A condiment dispensing utensil 100 can generally include a handle 105 operably coupled to a food-carrying portion 102. The handle can comprise an elongate hollow body 105, made up of one or more impervious walls defining an interior reservoir 110. Food-carrying portion 102 can comprise fork tines, a spoon bowl, or any of a variety of known utensils.

Figure 1B:
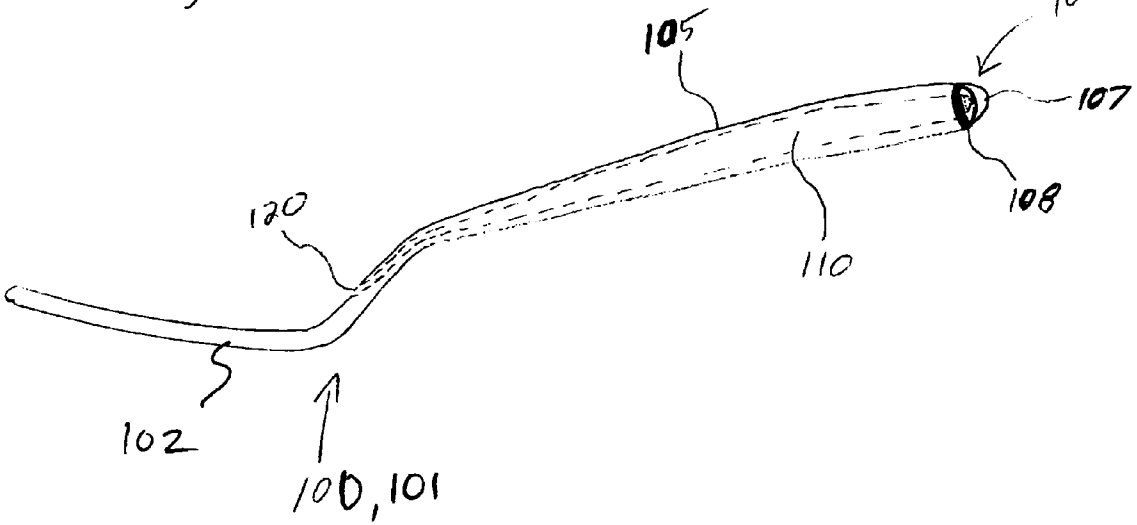
FIG. 1B is a side view of a condiment dispensing utensil in the form of a fork according to an embodiment of the invention.
Figure 4:
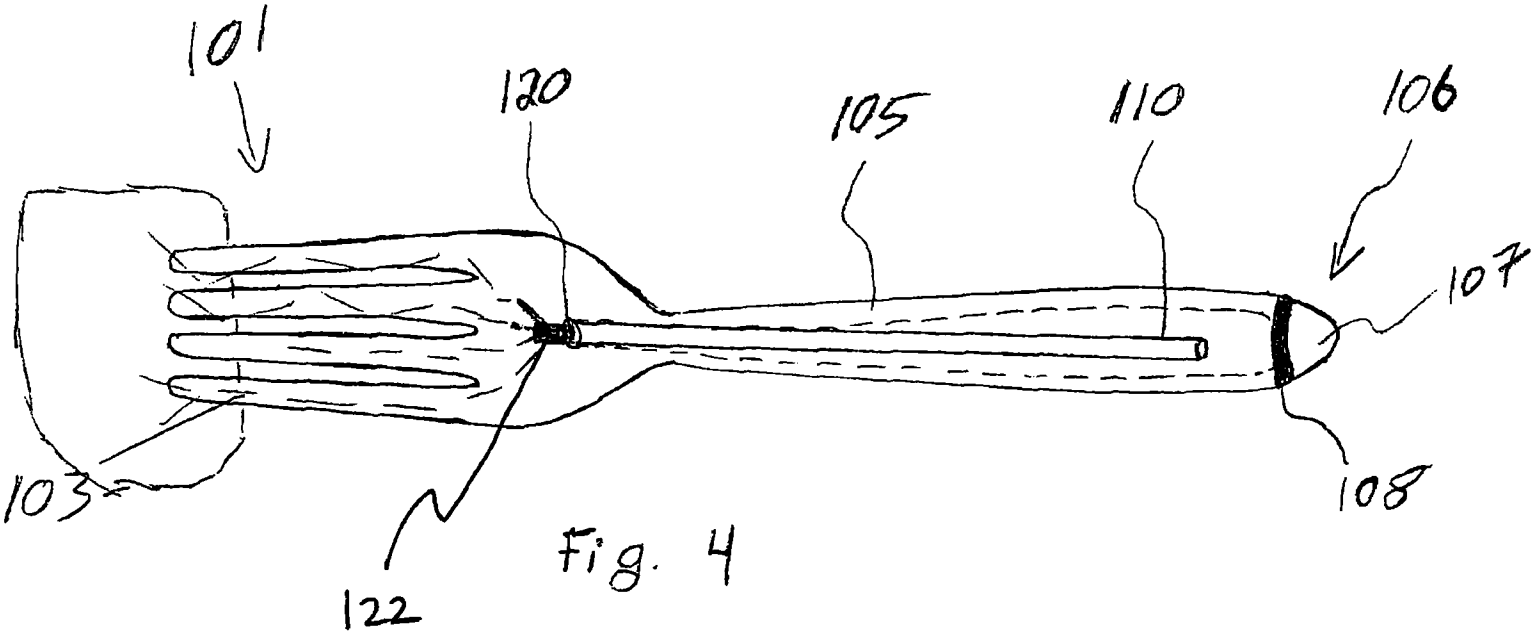
FIG. 4 is a top view of a condiment dispensing utensil having a spray pump mechanism according to an embodiment of the invention.

As illustrated in FIGS. 1A and 1B, a first representative embodiment of a condiment dispensing utensil 100, in this embodiment the utensil 100 is a fork 101. Fork 101 includes food-carrying portion 102 comprising a plurality of fork tines 103, a handle 105, a threaded cap assembly 106, a reservoir 110, and a dispensing port 120. Utensil 100 can also comprise any suitable food utensil such as, for example, a spoon, knife, spork, and other suitable utensils. In another embodiment of the invention, as illustrated in FIG. 4, condiment dispensing utensil further includes a pump mechanism 122, such as a spray pump mechanism.

Utensil 100 with handle 105 can be constructed of a plastic material suitable for storing a condiment for food intended for human consumption. In an alternative embodiment, utensil 100 with handle 105 can comprise any of a suitable number of materials including flexible plastic, glass, stainless steel, paper stock, aluminum foil, and other suitable materials and combinations thereof. The anterior end of the utensil is constructed to form a plurality of appropriately sized tines 103 in the general shape of a typical salad fork as shown. The interior of handle 105 is formed to create a condiment reservoir 110 of various sizes. Handle 105 can include a cap assembly 106 at the posterior end of utensil handle 105 to allow reservoir 110 to be filled before use and then refilled after use. Alternatively, handle 105 can be pre-filled and sealed in manufacturing, for single-use applications such as, for example, cafeterias, fast food restaurants, portable foods, and the like. In this embodiment, dispensing utensil 100 is disposable, and is manufactured from a recyclable or biodegradable plastic material.

At the location where fork tines 103 terminate to form handle 105 of utensil 100, a dispensing port 120 is located to allow the contents of reservoir 110 to be dispensed. Dispensing port 120 can comprise an structure defining an aperture, a nozzle, or any other suitable dispensing port. Optionally, dispensing port 120 may comprise a rubber or flexible plastic gasket or baffle (not depicted) to assist in retaining the condiment inside the reservoir. In other embodiments, depicted in FIGS. 4-13F, dispensing port 120 can include a spray pump mechanism 122 for spraying condiments, such as salad dressing, on a piece of food positioned on utensil 100, which will be described in more detail below. An example of a suitable spray pump mechanism is disclosed in U.S. Pat. No. 5,881,956 to Cohen et al., incorporated herein by reference in its entirety.

Figure 1F:
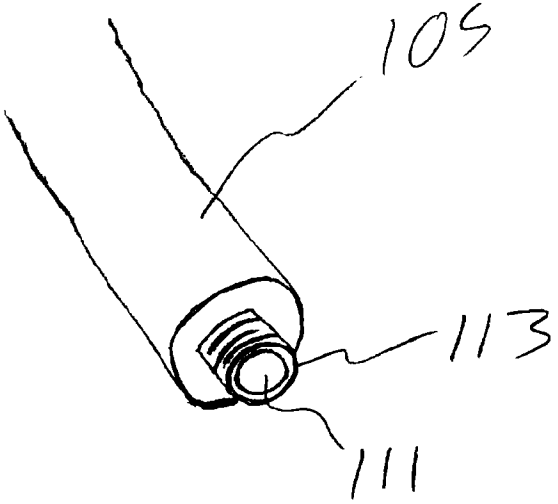
FIG. 1F is a perspective view of the posterior end of a condiment dispensing utensil lacking a cap according to an embodiment of the invention.
Figure 1D:
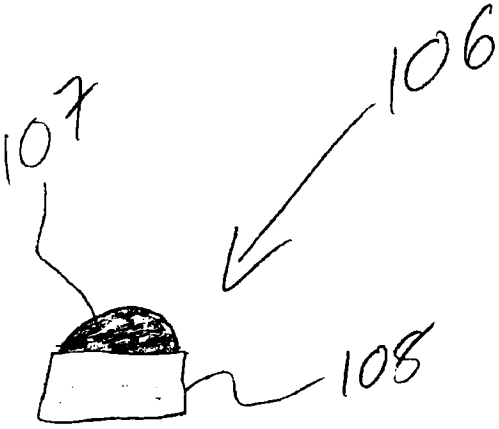
FIG. 1D is a side view of a cap for a condiment dispensing utensil according to an embodiment of the invention.
Figure 1E:
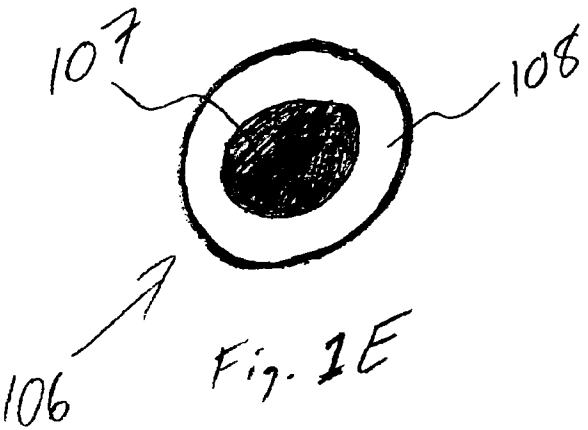
FIG. 1E is a top view of a cap for a condiment dispensing utensil according to an embodiment of the invention.

FIGS. 1C, 1D, and 1E depict an alternative embodiment of a cap assembly 106, which can be comprised of a deformable material forming a button 107 attached to a rigid material 108. The inner surface of rigid material 108 of cap 106 can be formed with threads 109 such that it can be removably attached to threaded posterior end 113 of handle 105, as depicted in FIG. 1F. Attaching cap 106 serves to seal the contents of reservoir 110 as well as to provide a mechanism to force the condiment in reservoir 110 out through dispensing port 120. The interior of cap assembly 106 is in fluid communication with reservoir 110 through filling port 111 such that when deformable button end 107 of cap 106 is depressed it creates pressure inside reservoir 110 which forces the contents of reservoir 110 out through dispensing port 120. The volume of deformable button end 107 of cap 106 is directly related to the quantity of condiment that is dispensed from reservoir 110, such that the user is able to limit the amount of condiment dispensed with each press of deformable button end 107 of cap 106.

An example of the utility of this embodiment would be for reservoir 110 to be filled with a pre-determined quantity of salad dressing. This would allow the user of condiment dispensing fork 101 to apply a bite-sized portion of salad dressing while consuming a salad. This use allows the salad consumer to precisely determine the quantity, and therefore the amount of calories, that he or she will consume with their salad. In one particular embodiment related to salad dressing, the serving size is about one to about four tablespoons of condiment, and more particularly about two tablespoons. Deformable button end 107 can be constructed of various sizes and mated with utensils possessing various sized reservoirs 110 in order to achieve the desired total quantity of condiment in the reservoir and the desired quantity of condiment that is to be dispensed with each button-push per bite of food.

Figures 2A, 2B:
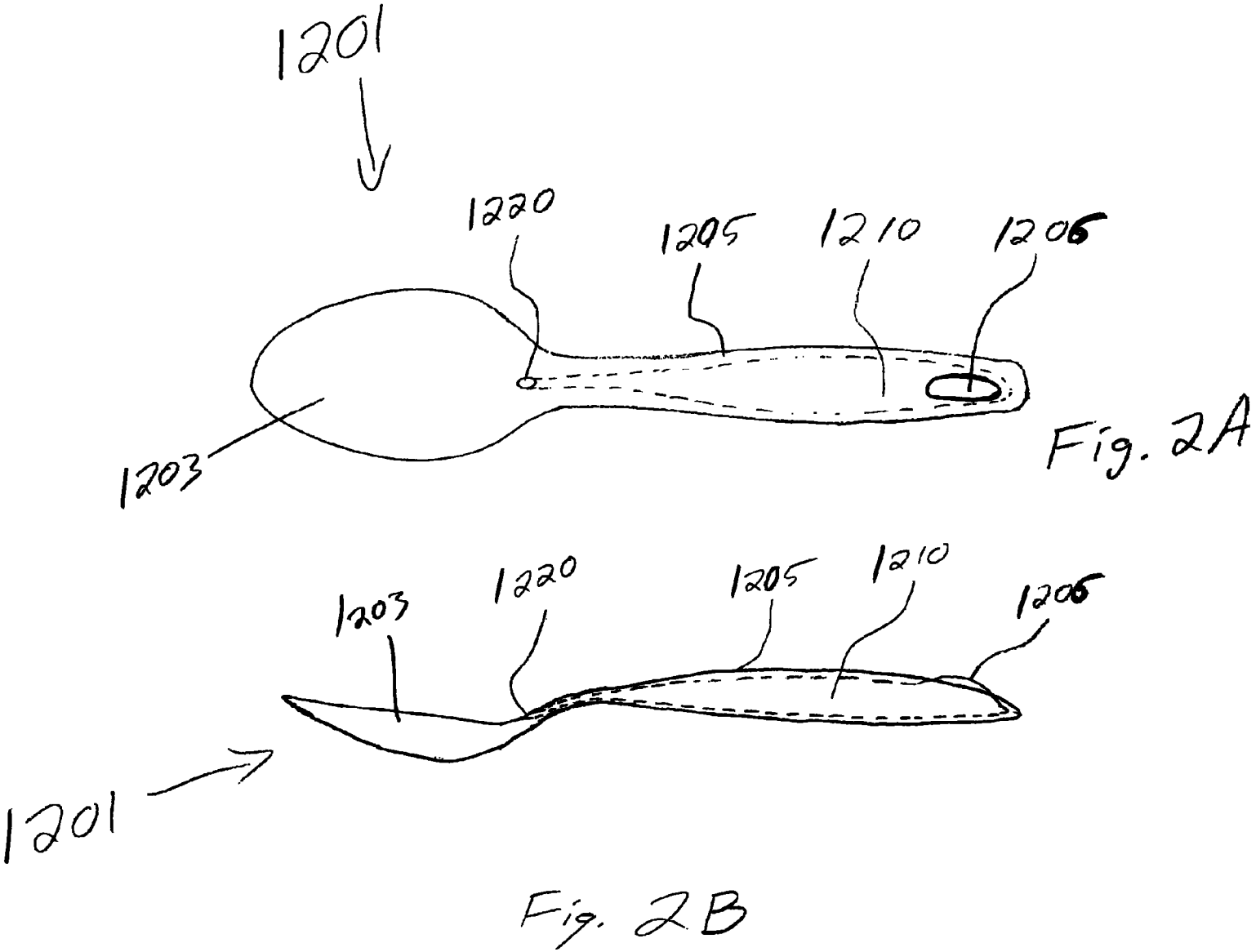
FIG. 2A is a side view of a condiment dispensing utensil in the form of a spoon according to an embodiment of the invention.

FIGS. 2A and 2B depict another possible embodiment of a condiment dispensing utensil in the form of a spoon 1201. This soup or desert spoon embodiment 1201 comprises a spoon bowl 1203, a handle 1205 comprising a hollow interior reservoir 1210, a deformable dispensing button 1206, and a dispensing port 1220. Deformable button 1206 is in fluid communication with interior condiment reservoir 1210. The embodiment of FIGS. 2A and 2B depicted a single-use condiment dispensing utensil due to the lack of a cap which was depicted in the earlier embodiment.

It should be noted that the embodiments of FIGS. 1A-1F and 2A-2B can be combined in various embodiments depending on the preferences of the user. For example, a condiment dispensing utensil could employ a deformable button located at the center of the handle, equidistant from both the anterior and posterior ends of the utensil, while also possessing a rigid threaded screw-type cap at the posterior end of the utensil. Alternatively, a single use condiment dispensing utensil could be constructed with a dispensing button located at the posterior end of the utensil handle. This embodiment would not require the additional expense of the threaded cap assembly. In yet another embodiment of the invention, an actuator can be positioned on one or more of the fork tines in the case of a fork such that when food is stabbed by or loaded onto the tines, the actuator is depressed, thereby actuating the pump to dispense condiment onto the loaded food.

FIG. 3 depicts yet another possible embodiment of a single-use condiment dispensing utensil. In this embodiment, depicted, but not limited to, a fork 301 comprises a plurality of tines 303, a handle 305 which is formed with a central opening designed to accommodate a handle shaped condiment packet 310 that can be affixed to the handle. Condiment packet 310 comprises a flexible outer membrane, such as a foil container typically found in fast-food restaurants to contain ketchup, mustard, mayonnaise, salad dressing, and the like. Condiment packet 310 also comprises a dispensing port 310 which can be sealed after the packet is filled, and then opened when the user is ready to dispense the contents of condiment packet 310.

Figure 5A:
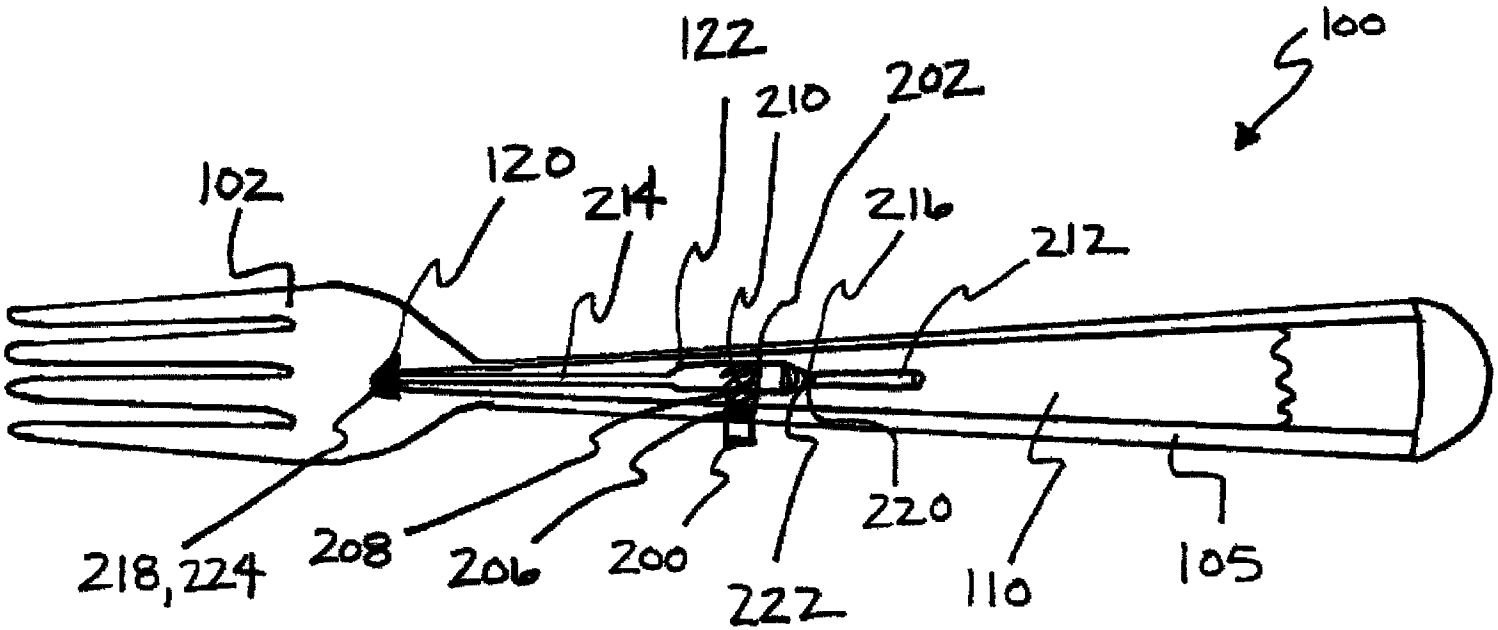
FIG. 5A is a top view of a condiment dispensing utensil having a spray pump mechanism in a non-actuated position.
Figure 5B:
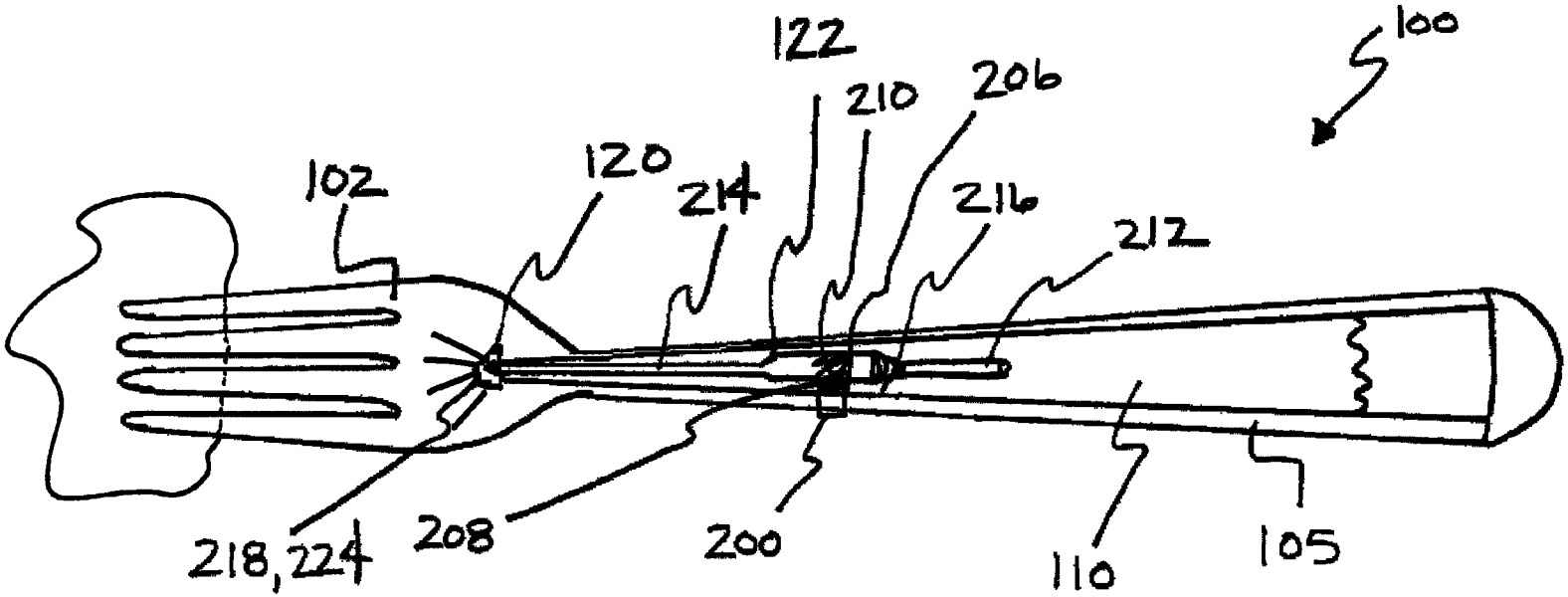
FIG. 5B is a top view of a condiment dispensing utensil having a spray pump mechanism in an actuated position.

In another embodiment and referring to FIGS. 4, 5*a* and 5*b*, spray pump mechanism 122 includes an actuator 200 operably coupled to a pump 202 and one or more one-way valves 216 and 218. Actuator 200 can comprise, for example, a trigger lever or actuating button positioned at a location on the exterior of the handle 105. Actuator 200 activates pump 202 including a piston 206 housed in a cylinder 208. Inside cylinder 208 can also comprise a compression spring 210. Pump 202 is operably coupled to a tube 212, such as a food-safe plastic tube, that draws the liquid condiment from reservoir 110. Pump 202 forces this liquid into a narrow barrel 214 and through and out of a dispensing port 120 such as a small hole, or other aperture or nozzle depending on the consistency and viscosity of the condiment being dispensed. Dispensing port 120, or nozzle, serves to focus the flowing liquid so that it forms a concentrated stream, or an atomized stream of liquid or fluid condiment. In one embodiment, a spray pattern can be adjusted by rotation of the nozzle at dispensing port 120.

To operate pump 202, and therefore spray pump mechanism 122, actuator 200 is pushed or otherwise actuated, which in turn pushes piston 206 into the cylinder 208. Moving piston 206 compresses spring 210, so when pressure on actuator 200 is released, piston 206 is pushed back out of the cylinder. These two strokes of piston 206, into cylinder 208 and out again, constitute an entire pump cycle. The downstroke, i.e. piston 206 pushing in, shrinks the area of cylinder 208, forcing fluid out of pump 202 and barrel 214, as illustrated in FIG. 5*b*. The upstroke, i.e. spring 210 forcing piston 206 back out, expands cylinder area 208, sucking fluid into pump 202 and barrel 214.

Spray mechanism 122 can further include two one-way valves in the pumping system: a first valve 216 between pump 202 and reservoir 110, and a second valve 218 between pump 202 and nozzle or dispensing port 120.

Typically, first valve 216 between pump 202 and reservoir 110 can comprise a tiny rubber ball 220 that rests neatly inside a small seal 222. The sides of seal 222 are angled so that ball 220 cannot fall through. Either gravity or a small spring holds ball 220 against seal 222 so that the dispensing passageway is blocked off when pump 202 is not actuated. When piston 206 moves out upon release of actuator 200, the expanding area of cylinder 208 sucks on the fluid condiment, pulling ball 220 up out of the seal 222. Because ball 220 is lifted up, fluid condiment is free to flow from reservoir 110. When pressure is applied to actuator 200, the outward force of the moving fluid condiment pushes ball 220 into seal 222, blocking off the passageway to reservoir 110. Consequently, the pressurized fluid condiment is pushed only into barrel 214.

Second valve 218 between pump 202 and nozzle or dispensing port 120 can comprise a valve cup 224 that is fitted over barrel 214. Second valve 218 is used in order to get the condiment moving through barrel 214. Pump 202 must only force the fluid up—it cannot force the fluid back into reservoir 110. In other words, the fluid must move through pump 202 in only one direction. On the upstroke, the inward pressure from pump 202 pulls valve cup 224 against barrel 214 so air cannot flow in through nozzle or dispensing port 120. On the downstroke, the fluid pushing out of barrel 214 lifts valve cup 224 off barrel 214 slightly and flows on through dispensing port 120. Without second valve 218, pump mechanism would not be able to draw fluid up from reservoir 110 because there would be no drop in air pressure, i.e. suction. The upstroke would not lower the air pressure in the pump and would only draw in more air to maintain the pressure.

In an alternative embodiment of the invention, not shown, the entire utensil is a single hollow body, i.e. the hollow elongate body of the handle is in fluid communication with a hollow body of the food-carrying portion. For example, in the case of a fork, handle and tines are a single hollow body, the interior of which makes up the reservoir. A pump mechanism is positioned on one or more of the tines. The pump mechanism can comprise a spray mechanism similar to that of a hair spray bottle in which the dispensing port is located on the actuator itself. In this embodiment, the actuator is located at a top of the tine, such that when food is stabbed, the actuator depresses, thereby beginning the pump cycle and forcing the condiment to be dispensed from the tine itself. In this embodiment, the pump (piston and chamber) are positioned in either the hollow tine itself, the transitional area from the tines to the handle, or the handle. In one particular embodiment, each tine of the plurality of tines has its own actuator and pump for dispensing condiment out of each tine.

Figure 6A:
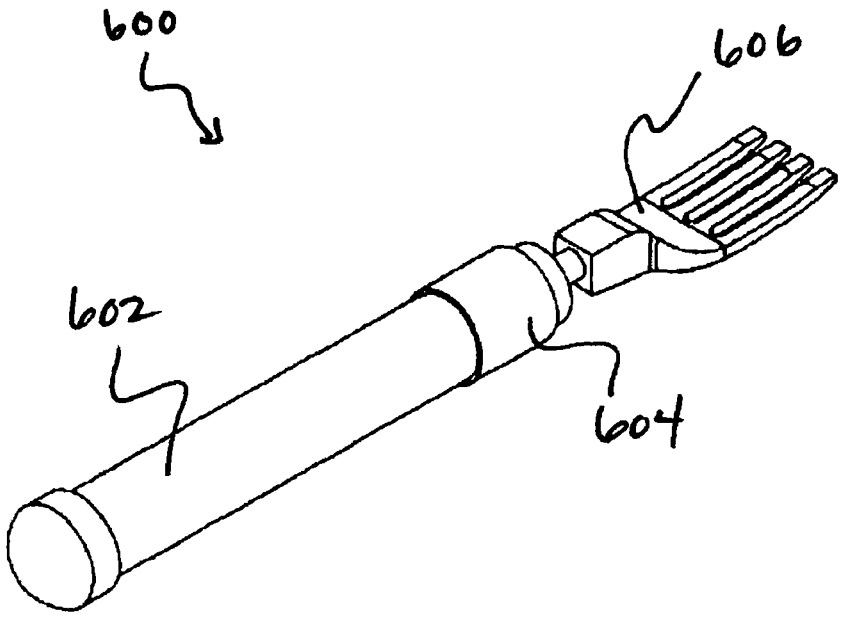
FIG. 6A is a rear top perspective view of a condiment dispensing utensil according to embodiment of the invention.
Figure 6B:
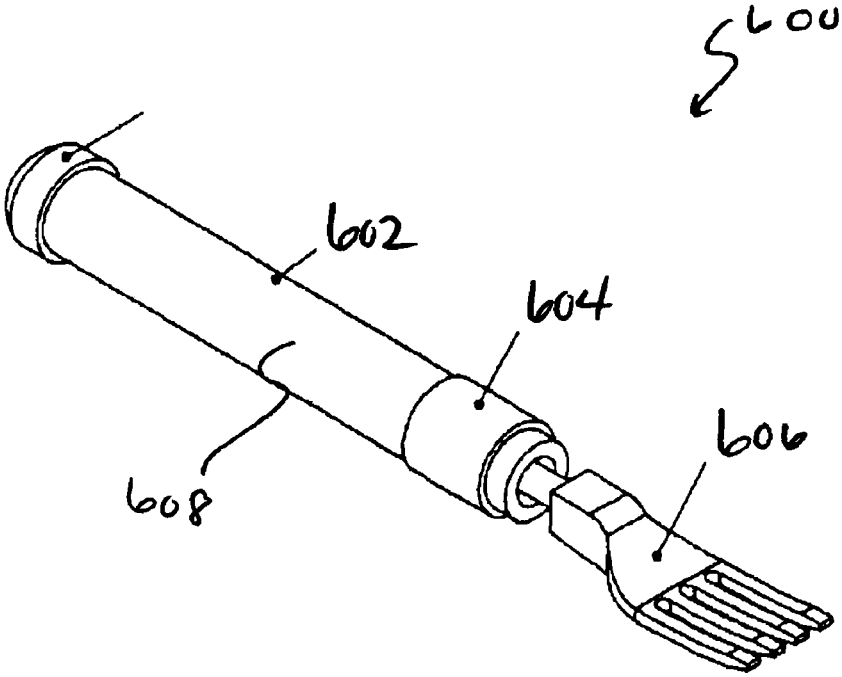
FIG. 6B is a front top perspective view of the condiment dispensing utensil of FIG. 6A.
Figure 6C:
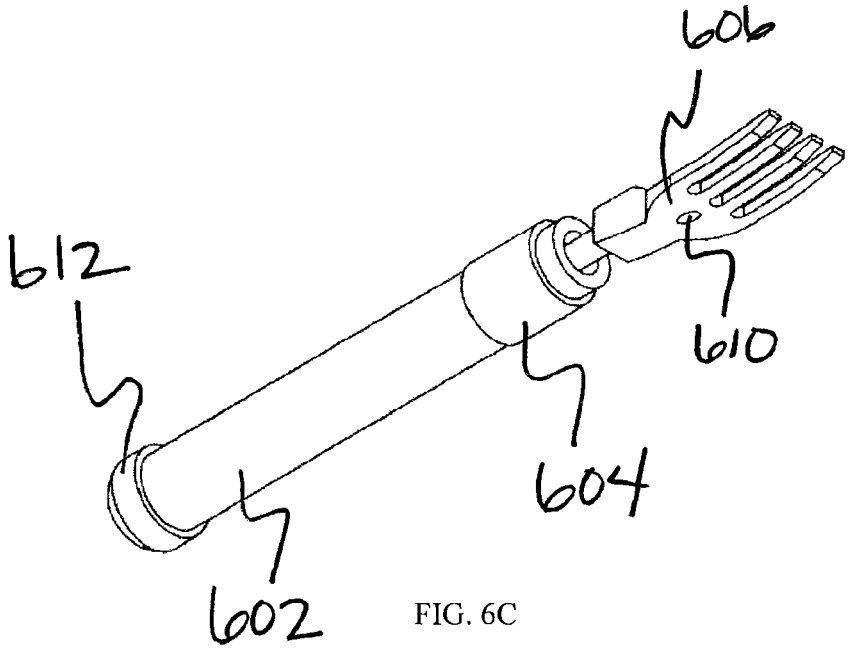
FIG. 6C is a front bottom perspective view of the condiment dispensing utensil of FIG. 6A.

FIGS. 6A-6C illustrate yet another alternative embodiment of the invention of a condiment dispensing utensil 600 including a hollow elongate handle 602, a pump 604 and a food-carrying portion 606. The interior of the hollow handle defines a reservoir 608 for receiving and storing a fluid condiment. In this embodiment, pump 604 is positioned between handle 602 and food-carrying portion 606. Food-carrying portion 606 itself acts as a pump actuator such that it is movable with relation to handle 602, and moves toward handle 602 when food is received via pressure on food-carrying portion 606, and moves away from handle 602 when the pressure is released. As food-carrying portion 606 shifts towards handle 602, a piston shifts within a chamber of pump 604, as described in previous embodiments and below, thereby forcing the fluid condiment through and out of a dispensing port from reservoir 608.

In one representative example illustrated in FIG. 6C, dispensing port 610 is positioned on a bottom surface of food-carrying portion 606.

Referring to FIGS. 8A-8C, handle 602 can generally comprise a hollow elongate body having a proximal end 612 and a distal end 614. Wall 616 can be made of any suitable material, such as a plastic material including polypropylene, polyethylene, polystyrene, acrylonitrile butadiene styrene, polyvinyl chloride, and any of a variety of moldable plastics and combinations thereof. Proximal end 612 can include a threaded portion 618 having external threads 620 defined thereon for threaded engagement of a pump, food-carrying portion or both with corresponding threading. Other attachment systems, such as a snap mechanism, latches, and the like can also be contemplated. In one embodiment of the invention, a first end of pump 604 has internal threading for threaded engagement to threaded portion 618, and a food-carrying portion 606 is attached to the other end of pump 604 such that reservoir 608 is in selective communication with food-carrying portion 606 through pump 604.

Figure 7C:
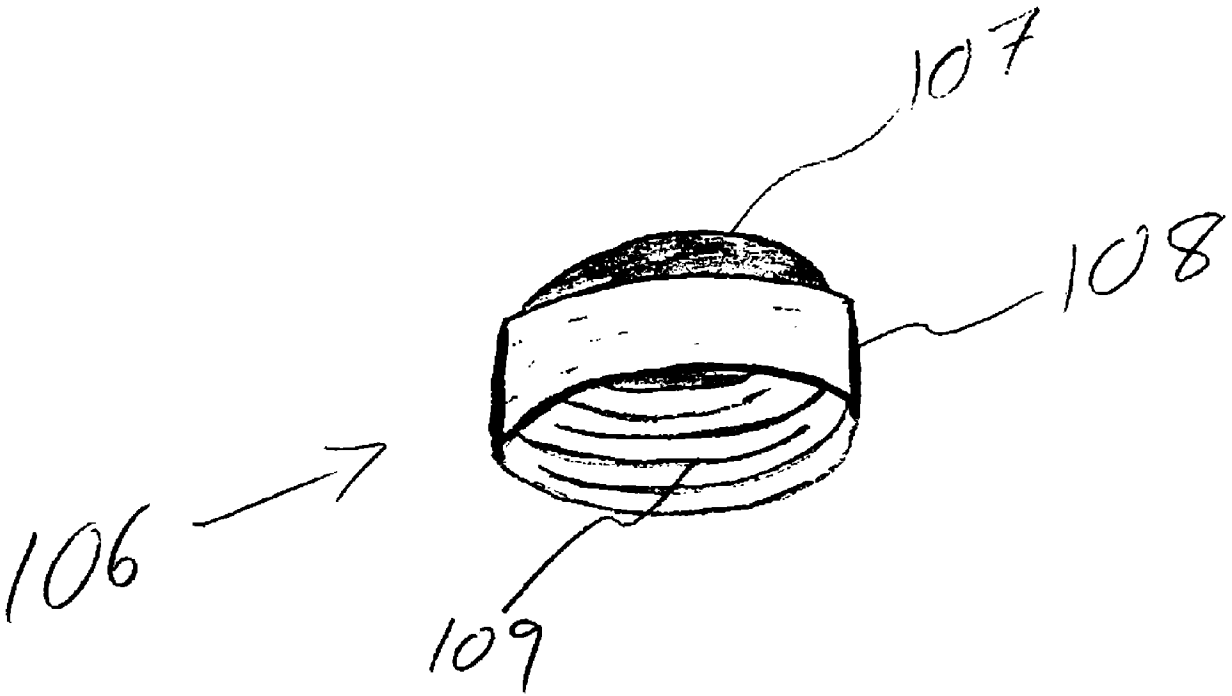
FIG. 7C is a cross section taken at A-A of the cap of FIG. 7B.
Figure 7C:
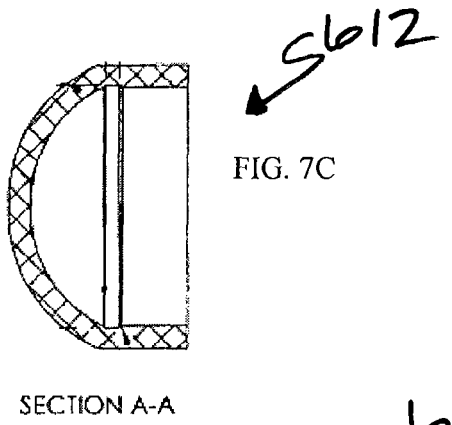
Figure 7A:
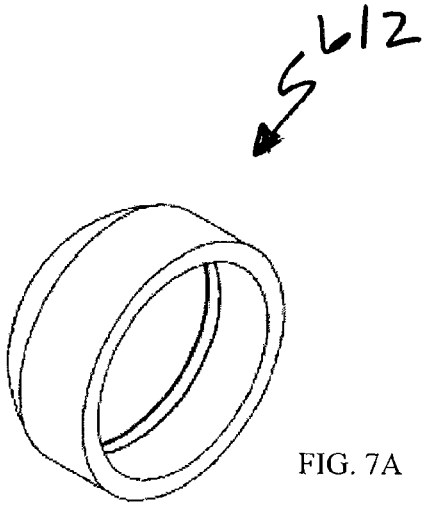
FIG. 7A is a perspective view of a cap of the condiment dispensing utensil of FIG. 6A.
Figure 7B:
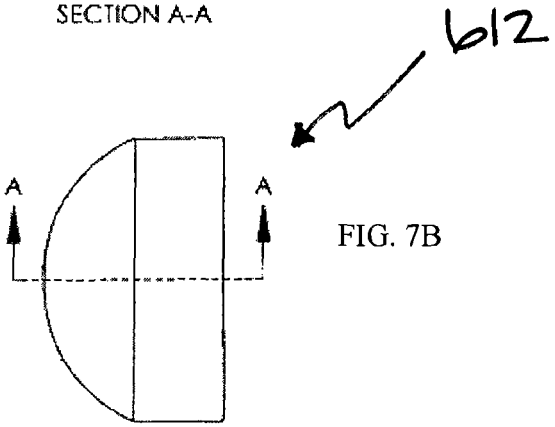
FIG. 7B is a side view of the cap of FIG. 7A.

In one embodiment of the invention, distal end 614 of handle 602 can further comprise an opening 611 for receiving condiment in which cap 612 of FIGS. 7A-7C can be removably received thereon.

Referring to FIGS. 11A-11D, pump 604 is a standard fluid pump known to one of ordinary skill in the art, such as one found in a bottle such as a hairspray or perfume bottle. Pump 604 is operably coupled to handle 602 on a first end such that a tube 625 fits into reservoir 608, while a second end is operably coupled to food-carrying portion 606 such that a barrel 630 (if present) is proximate or fits within dispensing port 610. A piston 626 shifts via pressure within chamber 628 to decrease the volume of chamber 628 thereby forcing fluid through barrel 630 and out of dispensing port 610. Upon release of pressure, the piston moves back out of chamber, increasing the volume, thereby pulling additional condiment from reservoir 610 into pump 604 through tube 612.

Referring to one embodiment, illustrated in FIGS. 9A-9D, food-carrying portion 606 can comprises a fork 622 having a plurality of tines 623. Food-carrying portion 606 can be a same material or different material then handle 602 so long as it is food safe. Fork 622 includes structure defining an access port 624 in fluid communication with pump 604 and handle 602. Dispensing port 610 can be located on any surface of food-carrying portion 606, such as a bottom surface 606*b*, and is in fluid communication with access port 624.

Referring to an alternative embodiment, illustrated in FIGS. 10A-10F, food-carrying portion 606 can comprise a dispensing port on a top surface 606*a*.

Referring to yet another embodiment of the invention, a food-carrying portion 606 comprises one or more dispensing ports 610 located on one or more of tines 623. Access port 624 allows for attachment to and fluid communication with pump 604 and handle 602. A coupling member 632 illustrated in FIGS. 13A-13F can also be used to aid in the fluid passage and attachment, and can be used as an interface allowing a user to attach different food-carrying portions to a single handle depending on the food application. For example, a user may want to switch between a fork and a spoon. Coupling member 623 includes structure defining a fluid passageway 634 therethrough.

Although specific examples have been illustrated and described herein, it will be appreciated by those of ordinary skill in the art that any arrangement calculated to achieve the same purpose could be substituted for the specific example shown. Any dimensions present in the drawings are for exemplary purposes only and are not intended to be limiting. This application is intended to cover adaptations or variations of the present subject matter. Therefore, it is intended that the invention be defined by the attached claims and their legal equivalents.

What is claimed is:

1. A fluid condiment dispensing utensil for dispensing a fluid condiment onto a food product, the condiment dispensing utensil comprising:

a handle comprising an elongate hollow body having a proximal end and a distal end, the elongate hollow body defining a condiment-receiving reservoir adapted to contain a condiment;

a food-carrying portion operably coupled to the proximal end of the handle;

a dispensing port in selective fluid communication with the reservoir, and positioned on the food-carrying portion; and a fluid pump mechanism selectively fluidly coupling the reservoir and the dispensing port, the fluid pump mechanism being adapted to pump condiment from the reservoir through and out of the dispensing port onto the food product upon actuation, wherein the fluid pump mechanism includes— a hollow elongated tube having a first end and a second end, the first end extending into the condiment-receiving reservoir, a pump operably coupled to and in selective fluid communication with the second end of the tube, the pump comprising a chamber defining an internal volume, and a piston shiftably positioned within the chamber upon actuation of the pump mechanism such that the internal volume increases during an upstroke of the pump to pull fluid into the chamber from the reservoir, and decreases during a downstroke of the pump to force fluid out of the chamber via the dispensing port, and a hollow elongated barrel operably coupled to and in fluid communication with the pump at a first barrel end, and wherein the second barrel end is selective fluid communication with the dispensing port, wherein the food-carrying portion is shiftable with respect to the handle to actuate the fluid pump mechanism, such that when the food-carrying portion shifts toward the handle, the piston shifts within the chamber of the pump, thereby forcing fluid out of the chamber, through the hollow elongated barrel, and through and out of the dispensing port.

2. The fluid condiment dispensing utensil of claim 1, wherein the dispensing port is positioned on either a top surface or a bottom surface of the food-carrying portion, proximate the proximal end of the handle.

3. The fluid condiment dispensing utensil of claim 1, wherein the utensil comprises a fork having a plurality of tines, and the dispensing port is positioned on at least one of the tines.

4. The fluid condiment dispensing utensil of claim 1, wherein the pump mechanism is coupled to the proximal end the handle on a first side of the pump, and coupled to the food-carrying portion on a second side of the pump.

5. The condiment dispensing utensil of claim 1, further comprising:

a filling port positioned in the distal end of the elongate hollow body; and a cap removably receivable on the distal end to block access to the filling port when the cap is received thereon.

6. The condiment dispensing utensil of claim 1, wherein the condiment comprises salad dressing, oil, vinegar, mayonnaise, ketchup, mustard, desert toppings, and combinations thereof.

* * * * *